US007465176B2

(12) United States Patent
Liao

(10) Patent No.: US 7,465,176 B2
(45) **Date of Patent: *Dec. 16, 2008**

(54) ADJUSTABLE POWER PLUG ADAPTER STRUCTURE

(76) Inventor: Sheng-Hsin Liao, No. 10, Alley 38, Lane 229, San Chun St., Shulin City (TW)

( * ) Notice: Subject to any disclaimer, the term of this patent is extended or adjusted under 35 U.S.C. 154(b) by 0 days.

This patent is subject to a terminal disclaimer.

(21) Appl. No.: 11/634,185

(22) Filed: Dec. 6, 2006

(65) Prior Publication Data

US 2008/0139050 A1 Jun. 12, 2008

(51) Int. Cl.
*H01R 29/00* (2006.01)

(52) U.S. Cl. ..... 439/172

(58) Field of Classification Search ..... 439/170–173, 439/640

See application file for complete search history.

(56) References Cited

U.S. PATENT DOCUMENTS 2,291,793 A * 8/1942 Chandler ..... 439/369
2,624,776 A * 1/1953 Price ..... 439/172
4,136,918 A * 1/1979 Claesson et al. ..... 439/172
5,069,634 A * 12/1991 Chiarolanzio ..... 439/353
6,247,941 B1 * 6/2001 Lee et al. ..... 439/105
7,287,994 B1 * 10/2007 Liao ..... 439/172

* cited by examiner

*Primary Examiner*—Neil Abrams
(74) *Attorney, Agent, or Firm*—Rosenberg, Klein & Lee

(57) ABSTRACT

An adjustable power plug adapter structure comprises an insulating case, a first inserted member, a second inserted member, and a plug. The insulating case has two side arms and a pivoting portion. The first and second inserted members are oppositely joined in the insulating case, and electrically connected. The plug is movably assembled to the insulating case. The plug has a third inserted member which is mated to the second inserted member. The plug has a sliding groove on its side, and the sliding groove corresponds to the first pivoting portion. Making use of this structure, the insulating case, the first inserted member, and the second member form an adjustable power plug adapter. When one adjustable power plug adapter is not used, it can slide and rotate away. The adjustable power plug adapters can be assembled together to correspond to a variety types of receptacles.

39 Claims, 8 Drawing Sheets

ADJUSTABLE POWER PLUG ADAPTER STRUCTURE

BACKGROUND OF THE INVENTION

1. Field of the Invention

The present invention relates to an adjustable power plug adapter structure and, more particularly, to a power plug adapter with a transformer and a plug that can be adjusted in order to connect with various different voltage levels. The adjustable power plug adapter can be adjustable so that it corresponds to a variety of types of power plug adapter receptacles.

2. Description of Related Art

When a conventional power cord is electrically connected to an electronic device, a power plug on one end of the power cord is inserted into a corresponding receptacle of the electronic device. Through the power plug and the receptacle, electricity flows from the power cord into the electronic device. However, when different types of power plug and receptacle are used, it is necessary to use an adjustable power plug adapter and then insert the adjustable power plug adapter into the receptacle of the device to make the connection between the power plug and the receptacle.

A fixed type of assembly manner is usually used between the power plug adapter and the power plug. If the adjustable power plug adapter is not used, it is usually disassembled. The next time the power plug adapter is used then, it has to be assembled again. Therefore, the power plug adapter is inconvenient in practical use.

Accordingly, the present invention aims to provide a transfer power plug structure that solves the above-described problems.

SUMMARY OF THE INVENTION

An object of the present invention is to provide an adjustable power plug adapter structure which can slide and rotate in different directions so that it doesn't need to be disassembled, thereby enhancing convenience.

Another object of the present invention is to provide an adjustable power plug adapter structure, in which a first inserted member and a second inserted member are disposed in an insulating case to form an adjustable power plug adapter. The adjustable power plug adapters can be assembled together to correspond to a variety of receptacles.

To achieve the above objects, the present invention provides an adjustable power plug adapter structure, which comprises an insulating case, a first inserted member, a second inserted member, and a plug. The insulating case has two side arms and a pivoting portion. The first and second inserted members are oppositely joined in the insulating case, and electrically connected to each other. The plug is movably assembled to the insulating case. The front end of the plug has a third inserted member which is mated to the second inserted member. A sliding groove is concavely disposed on a side of the plug, and the sliding groove corresponds to the first pivoting portion. A sliding groove is further concavely disposed on a side of the insulating case. In order to offer further understanding the characteristics and technical contents of the present invention, a detailed description thereof will be made with reference to the accompanying drawings. However, it should be understood that the drawings and the description are illustrative and not used to limit the scope of the present invention.

DETAILED DESCRIPTION OF THE PREFERRED EMBODIMENTS

Figure 1:
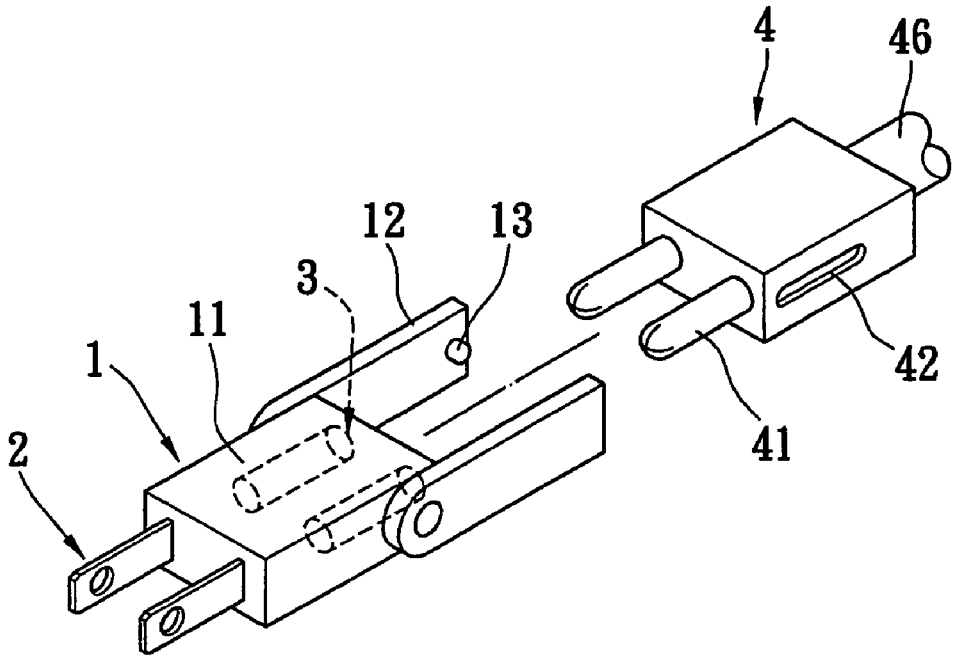
FIG. 1 is a first perspective exploded view of the present invention.
Figure 2:
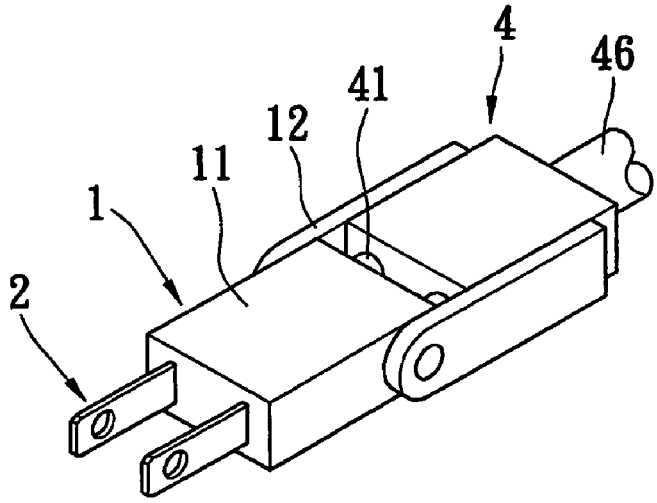
FIG. 2 is a perspective assembly view of the present invention.
Figure 3:
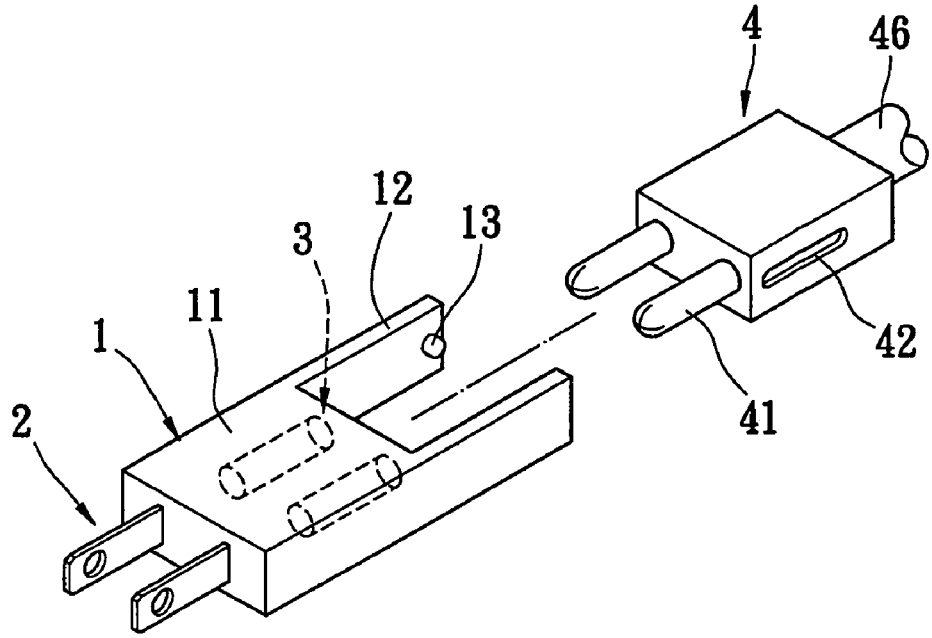
FIG. 3 is a second perspective exploded view of the present invention.

As shown in FIGS. 1 to 3, the present invention provides an adjustable power plug adapter structure, which comprises an insulating case 1, a first inserted member 2, and a second inserted member 3.

The insulating case 1 is made of insulating material such as plastic. The insulating case 1 has a main body 11 and two side arms 12 linked with the main body 11. A first pivoting portion 13 is formed on an inner edge surface of each of the side arms 12. The first pivoting portion 13 can be protruding posts. The side arms 12 can be of a fixed type. That is, the side arms 12 are integrally formed with the main body 11, and extend from the main body 11, as shown in FIG. 3. Alternatively the two side arms 12 can be joined on both sides of the main body 11 by using pivotal posts to allow rotation.

The first inserted member 2 is joined at a front end of the main body 11 of the insulating case 1. The second inserted member 3 and the first inserted member 2 are oppositely joined in the main body 11, and electrically connected to each other. The first and second inserted members 2 and 3 are electronically connected by providing terminals (not shown) between them. In this embodiment, the first inserted member 2 is a plurality of conducting pins, which can be of two-terminal or three-terminal type used in the US, the EU, or Australia. Making use of this structure, the insulating case 1, the first inserted member 2 and the second inserted members 3 form an adjustable power plug adapter.

The present invention further comprises a plug 4. A third inserted member 41 is disposed at a front end of the plug 4. The third inserted member 41 can be a two-terminal or a three-terminal type. The second inserted member 3 is a receptacle of conducting pins mated to the third inserted member 41. Sliding grooves 42 are concavely disposed on both sides of the plug 4. The plug 4 can be movably assembled to the insulating case 1. The first pivoting portions (protruding posts) 13 can be correspondingly received in the sliding grooves 42 allow the plug 4 be movably assembled to the insulating case 1. The third inserted member 41 of the plug 4 can be inserted into the second inserted member 3 to achieve electronic connection.

Figure 4:
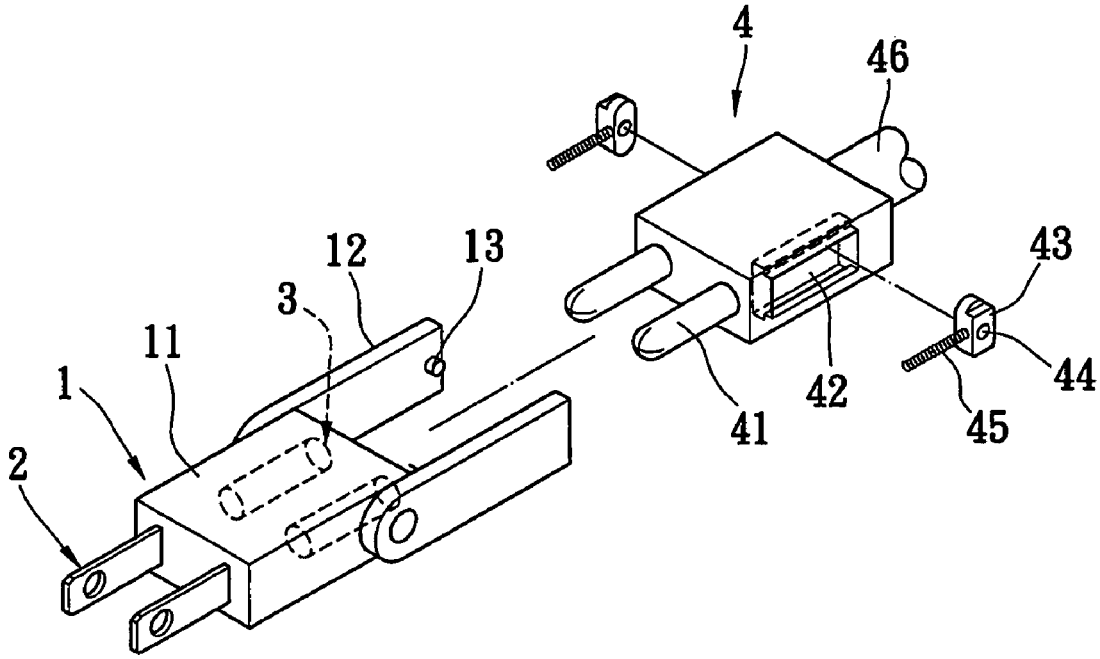
FIG. 4 is a perspective exploded view showing how the plug is connected with the sliding piece and the elastic member in the present invention.
Figure 5:
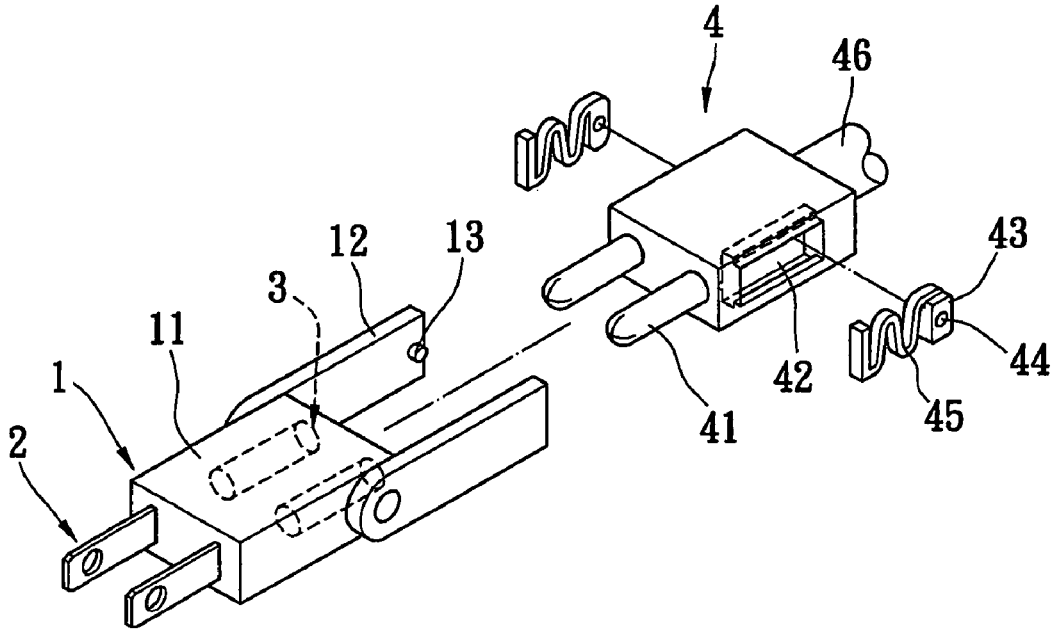
FIG. 5 is another perspective exploded view showing how the plug is connected with the sliding piece and the elastic member in the present invention.

As shown in FIGS. 4 and 5, the structure of the plug 4 can vary. A movable sliding piece 43 can be received in each of the sliding grooves 42. A second pivoting portion 44 correspondingly joined with the first pivoting portion 13 is disposed on the surface of the sliding piece 43. The first and second pivoting portions 13 and 44 can be altered to any combination of corresponding protruding posts and circular holes. The sliding pieces 43 can slide back into the sliding grooves 42 to achieve the above-mentioned functions.

An elastic member 45 can further be received in each of the sliding grooves 42. Two ends of the elastic member 45 abut against one side of the sliding piece 43 and a wall of the sliding groove 42 to allow the sliding piece 43 to elastically move back and force and to allow the third inserted member 41 to be elastically mated to the second inserted member 3. The elastic member 45 can be a spring or an elastic plate. If the elastic member is an elastic plate, the elastic plate can be integrally formed with the sliding piece 43, and is extended and bended from one side of the sliding piece 43.

Figure 6:
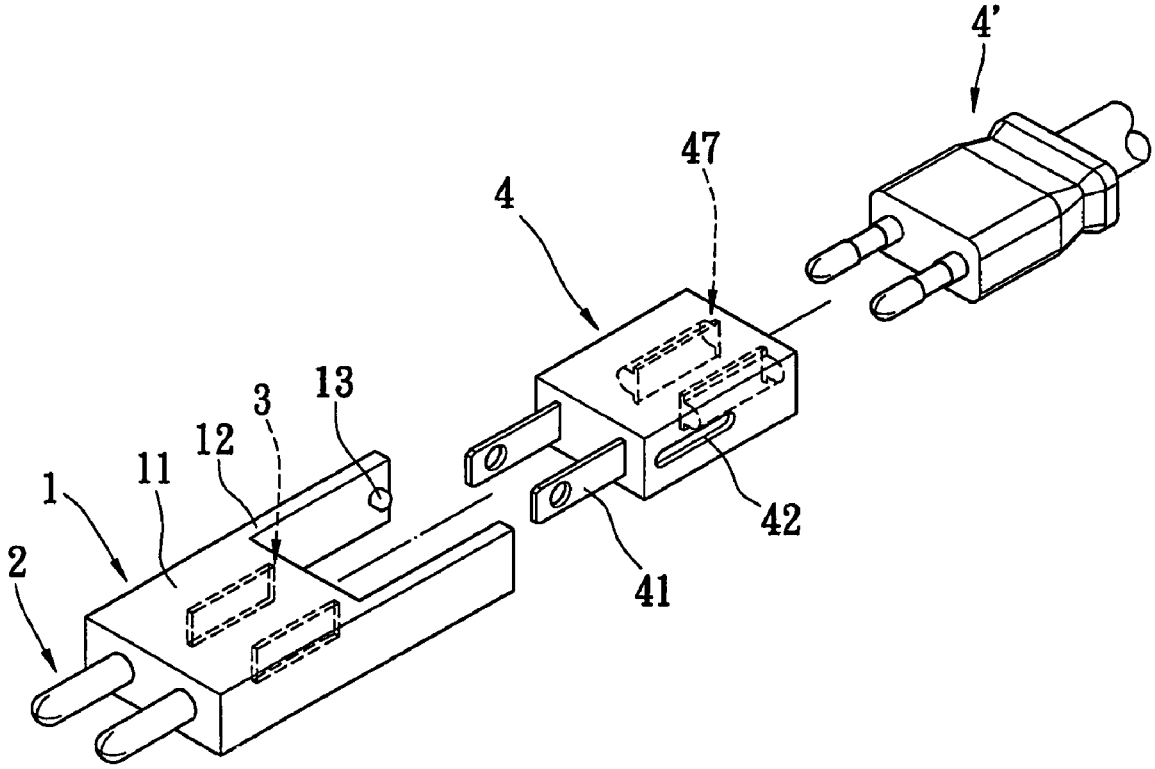
FIG. 6 is a third perspective exploded view of the present invention.

As shown in FIGS. 1 to 5, a power cord 46 can be electrically connected to a rear end of the plug 4 to directly form a power plug. Additionally, as shown in FIG. 6, the structure of the plug 4 can vary. A fourth inserted member 47 can be disposed at the rear end of the plug 4. In FIG. 6, the fourth inserted member 47 is a receptacle of another type. The fourth inserted member 47 can also be a plurality of conducting pins of another type. The plug 4 can thus form an adjustable power plug adapter to be mated to a power plug 4' of another type.

Figure 7:
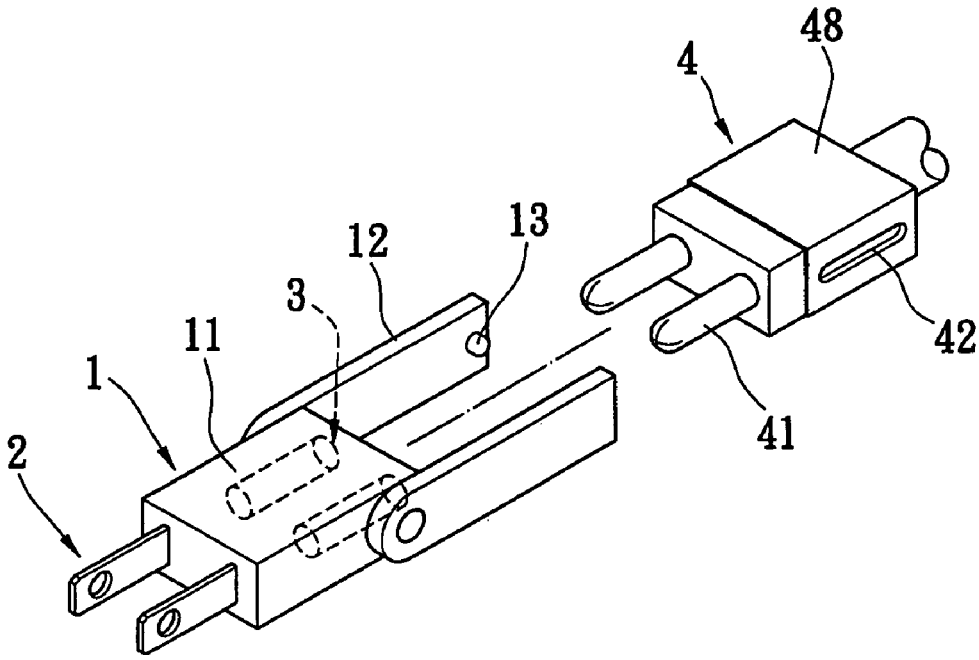
FIG. 7 is a fourth perspective exploded view of the present invention.

As shown in FIG. 7, a seal 48 can be formed at the rear end of the plug 4 by means of injection molding. The sliding grooves 42 can be disposed on both sides of the seal 48. The sliding pieces and elastic members (not shown) can also be disposed in the sliding grooves 42 to achieve the above-mentioned functions.

Figure 8:
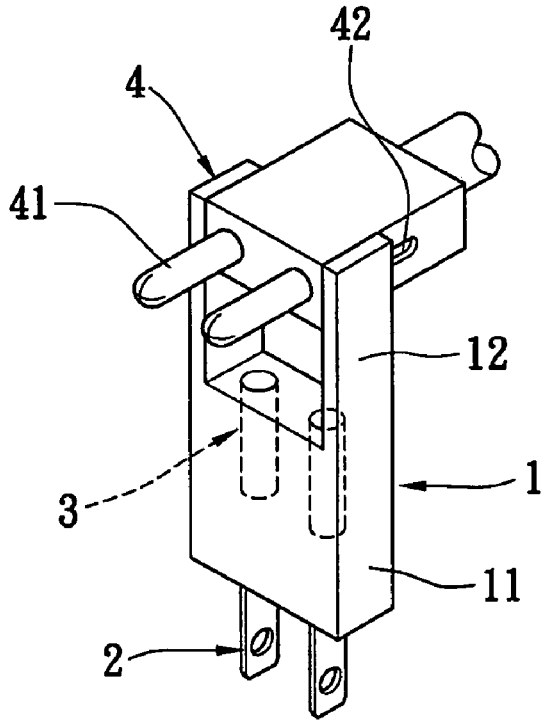
FIG. 8 is an assembly diagram of the present invention.
Figure 9:
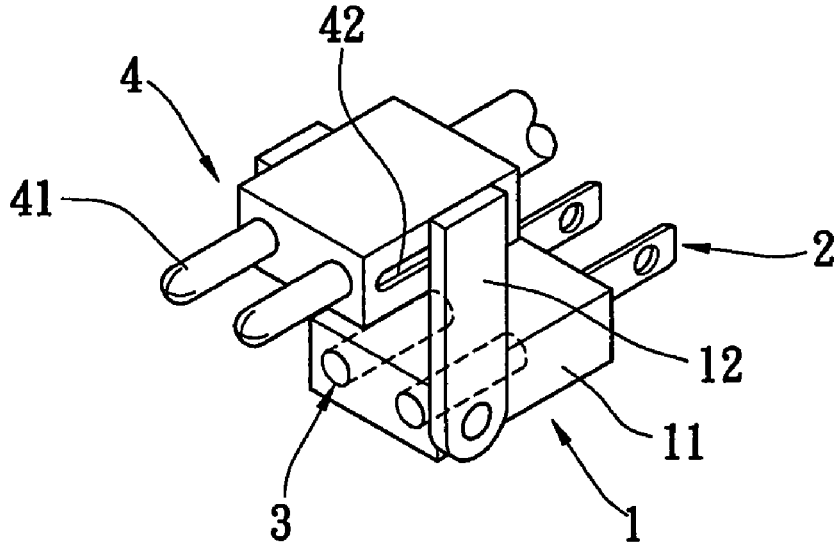
FIG. 9 is another assembly diagram of the present invention.

Reference is made to FIGS. 8 and 9 and FIG. 1. When the plug 4 of the present invention is assembled to the insulating case 1 and the plug 4 is not used, the plug 4 can be pulled out to make the third inserted member 41 disconnect from the second inserted member 3 through the sliding collocation between the first pivoting portions 13 and the sliding grooves 42. Via the first pivoting portions 13, the plug 4 can slide between the two side arms 12 and rotate in any direction. The plug 4 can thus be used alone without disassembling the adjustable power plug adapter, hence enhancing convenience. Moreover, the side arms 12 by mating with the first inserted member 2 can rotate to increase the number of directions that the plug 4 can be rotated.

Figure 10:
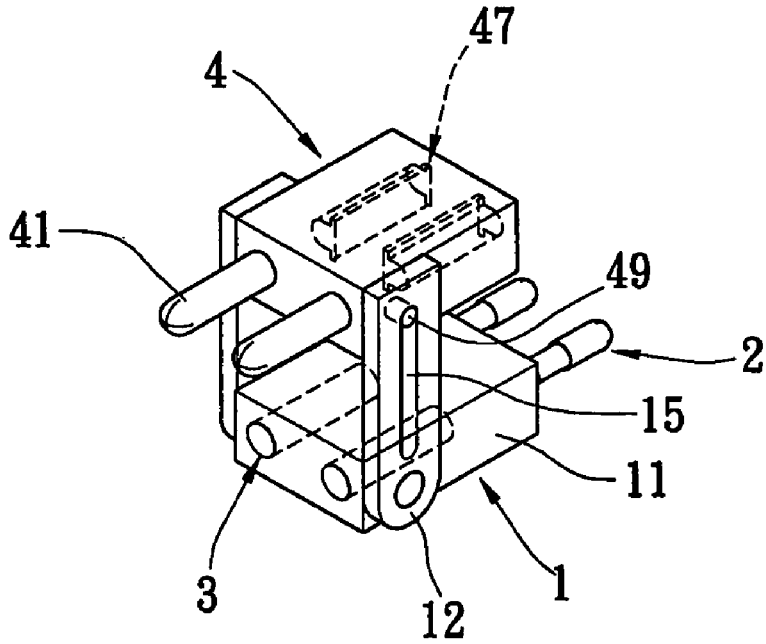
FIG. 10 is yet another assembly diagram of the present invention.

FIG. 10 is an assembly diagram according to a third embodiment of the present invention. As shown in FIG. 10, the structures of the insulating case 1 and the plug 4 can vary. The third embodiment differs from the previous embodiments in that another sliding groove 15 is formed on each of the side arms 12 of the insulating case 1 and another first pivoting portion 49 is formed on a side of the plug 4. The first pivoting portions 49 can be protruding posts. The first pivoting portions 49 of the plug 4 can be assembled in the sliding grooves 15 of the insulating case 1 and can slide and rotate to accomplish the same objective stated above. The sliding pieces, the second pivoting portions and the elastic members (not shown) of the previous embodiments can also be disposed in the sliding grooves 15 of the insulating case 1 to achieve the above-mentioned functions.

Figure 11:
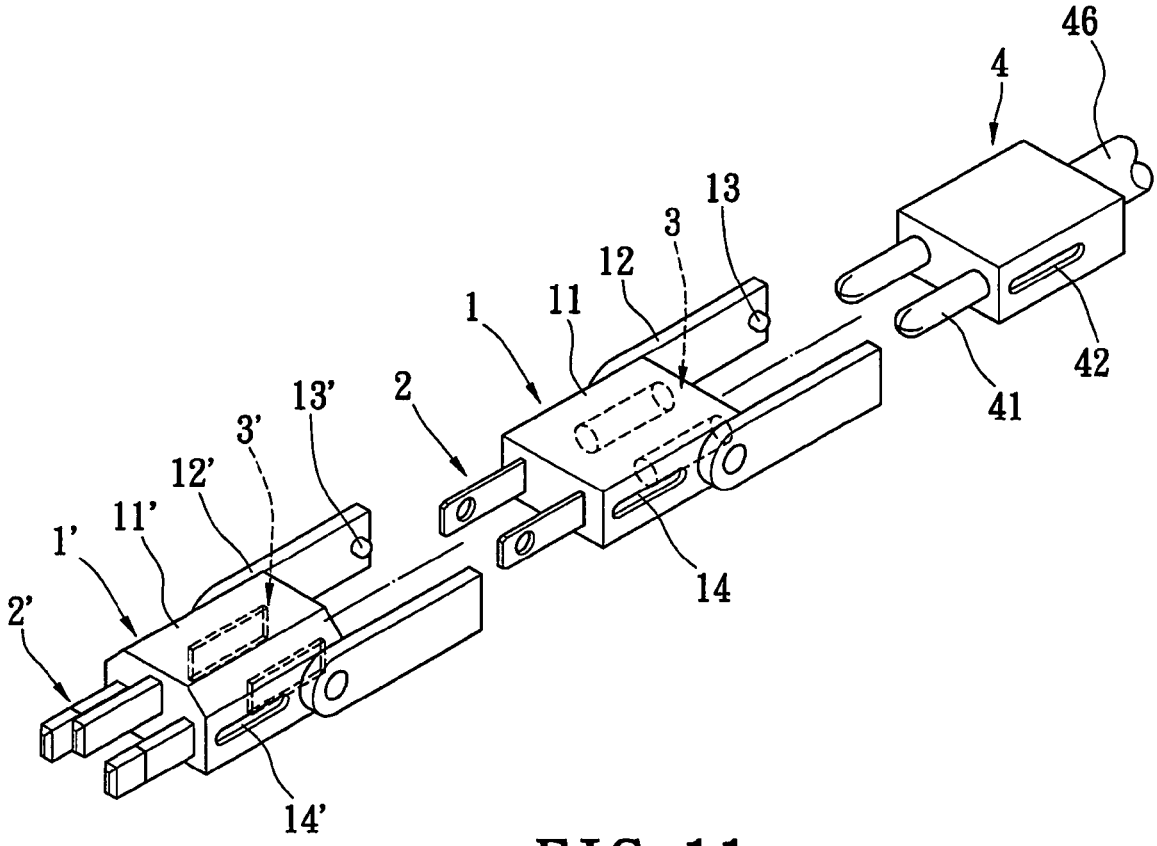
FIG. 11 is an assembly diagram of a plurality of the plugs of the present invention.

As shown in FIG. 11, sliding grooves 14 can further be concavely disposed on both sides of the main body 11 of the insulating case 1. In this embodiment, the insulating case 1, the first inserted member 2, and the second inserted member 3 form a first adjustable power plug adapter. A corresponding second adjustable power plug adapter can be assembled to the front end of the first adjustable power plug adapter. The second adjustable power plug adapter comprises an insulating case 1', a first inserted member 2', and a second inserted member 3'. The insulating case 1' also has a main body 11', two side arms 12', and two first pivoting portions 13'. The main body 11' also has two sliding grooves 14'. The first pivoting portions 13' of the two side arms 12' of the second adjustable power plug adapter can be received in the sliding grooves 14 of the first adjustable power plug adapter to let the insulating case 1' of the second adjustable power plug adapter be movably assembled to the insulating case 1 of the first adjustable power plug adapter.

The second inserted member 3' of the second adjustable power plug adapter is a corresponding receptacle for the first inserted member 2 of the first adjustable power plug adapter, and the first inserted member 1' of the second adjustable power plug adapter is a plurality of conducting pins of another type. The first adjustable power plug adapter can thus be converted to a connector for another type via the second adjustable power plug adapter, thereby forming a receptacle of another type. The user can assemble the second, third and fourth adjustable power plug adapters to make the plug 4 of the present invention correspond to a variety of receptacles.

Figure 12:
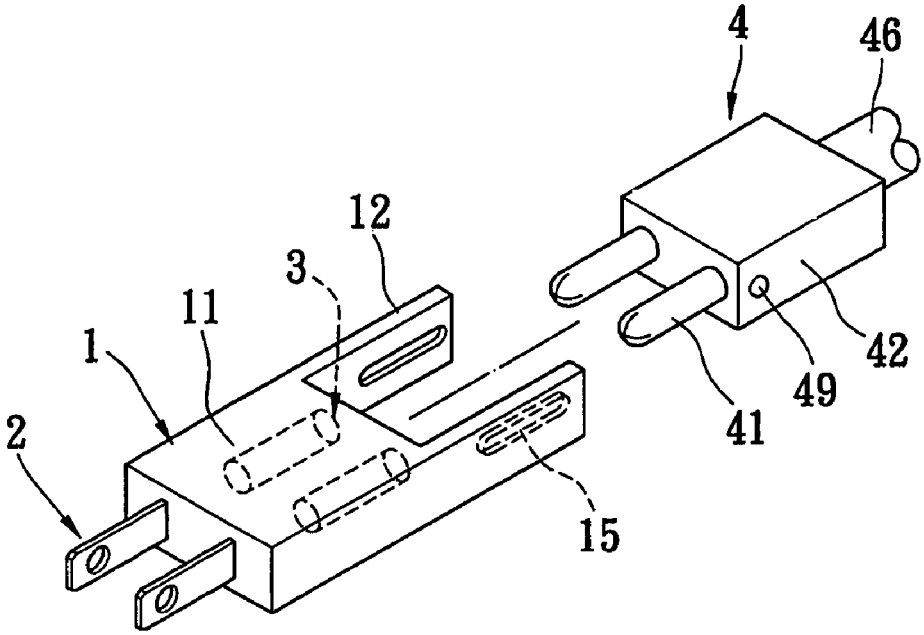
FIG. 12 is a fifth perspective exploded view of the present invention.

As shown in FIGS. 10 and 12, the sliding grooves 15 of the insulating case 1 can be hollowed out so that the two side arms 12 concavely disposed on the two side arms 12 can be penetrated to achieve the above-mentioned functions.

Figure 13:
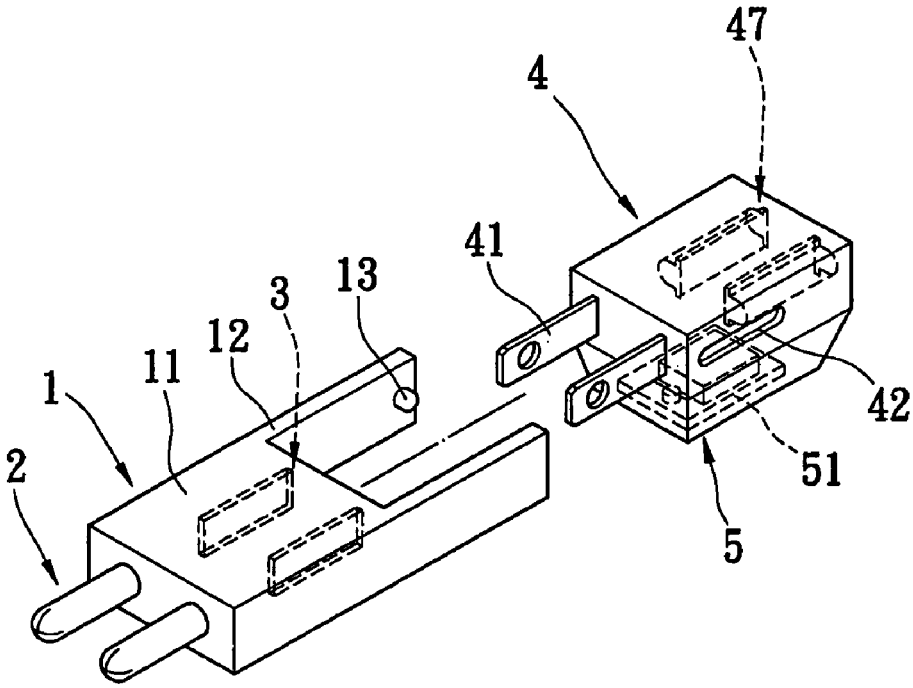
FIG. 13 is a diagram showing how the plug of the present invention is connected with an electrical storage device.

As shown in FIG. 13, an electrical storage device 5 can further be joined on the surface of the bottom end of the plug 4 having a fourth inserted member 47 at its rear end. The third inserted member 41 and the fourth inserted member 47 are electrically connected to the electrical storage device 5. The electrical storage device 5 has a circuit board 51 and electronic components such as ICs, resistors, and capacitors on the circuit board 51 therein. When the third inserted member 41 is mated to the second inserted member 3 and the first inserted member 2 of the insulating case 1 is inserted into a receptacle, electricity can be stored in the electrical storage device 5 via the power transferred from the receptacle. When the fourth inserted member 47 is mated to another plug 4', electricity can flow to the plug 4'. If the voltage of the receptacle is unstable and drops, the electrical storage device 5 can be used to stabilize the voltage so as to avoid damage of the electronic device due to insufficient voltage being transferred to the plug 4'.

Figure 14:
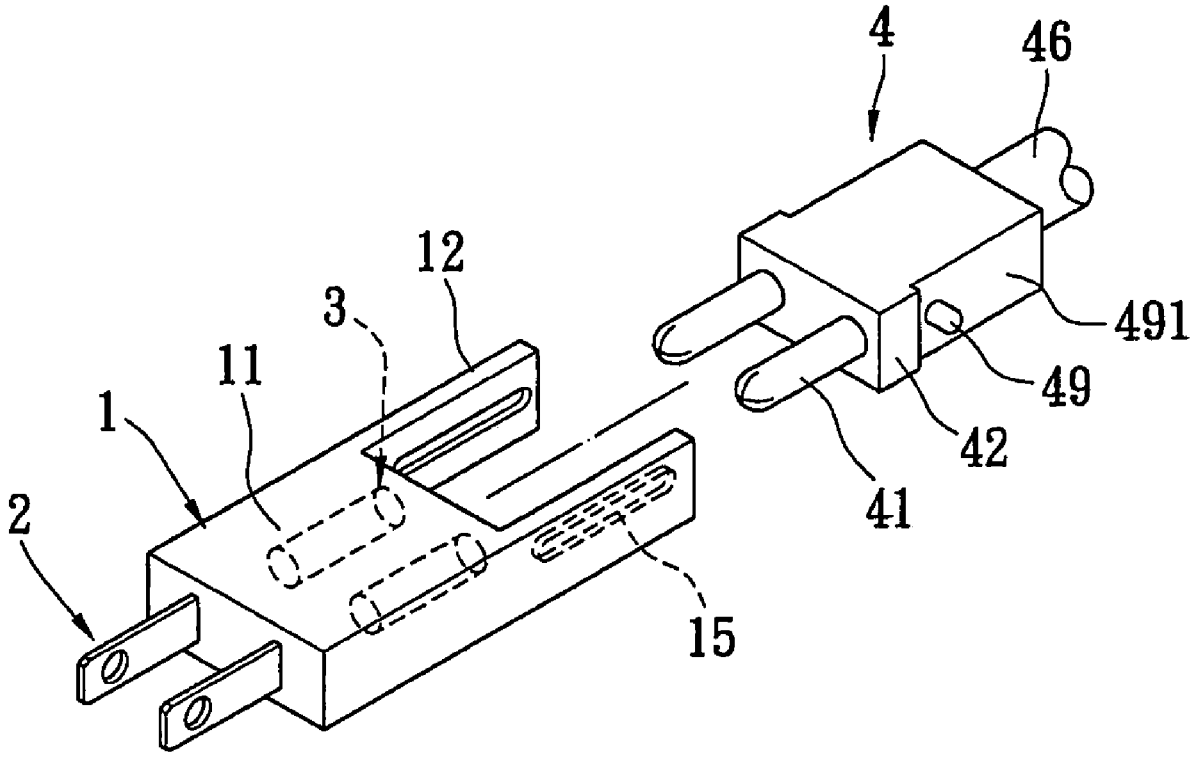
FIG. 14 is a sixth perspective exploded view of the present invention.

Moreover, as shown in FIG. 14, the shape and structure of the plug 4 can vary. In this embodiment, indent portions 491 are concavely disposed on both sides of the plug 4, the first pivoting portions 49 are formed in the indent portions 491, and the first pivoting portions 49 can be lengthened, thereby allowing the plug to be movably assembled to the insulating case 1.

To sum up, the present invention has the following characteristics and functions:

1. The insulating case and the first and second inserted members of the present invention form an adjustable power plug adapter. When the plug is assembled to the insulating case, it can achieve electronic connection with the second inserted member. Through the sliding collocation between the first pivoting portions and the sliding grooves, when the plug is not used, it can slide between the two side arms and rotate. The plug can thus be used alone without disassembling the adjustable power plug adapter, hence enhancing convenience.

2. Sliding pieces and elastic members are further disposed in the sliding grooves of the present invention so that the plug can be elastically mated to the second inserted member to further enhance convenience.

3. The adjustable power plug adapters can be assembled together to correspond to a variety types of receptacles. Moreover, through the sliding grooves, the adjustable power plug adapter can be adjusted to a specific receptacle without disassembling other adjustable power plug adapters.

Although the present invention has been described with reference to the preferred embodiments thereof, it will be understood that the invention is not limited to the details thereof. Various substitutions and modifications have been suggested in the foregoing description, and others will occur to those of ordinary skill in the art. Therefore, all such substitutions and modifications are intended to be embraced within the scope of the invention as defined in the appended claims.

What is claimed is:

1. An adjustable power plug adapter structure, comprising:

an insulating case having two side arms with a first pivoting portion;

a first inserted member and a second inserted member oppositely joined in the insulating case and electrically connected to each other; and a plug movably assembled to the insulating case, a third inserted member mated to the second inserted member being disposed at a front end of the plug, the plug having a sliding groove concavely on a side thereof to correspond to the first pivoting portion for moveable connection of the insulating case to the plug.

2. The adjustable power plug adapter structure as claimed in claim 1, wherein the insulating case has the slide groove concavely on the side thereof.

3. The adjustable power plug adapter structure as claimed in claim 1, wherein the two side arms are rotatably joined on both sides of the insulating case.

4. The adjustable power plug adapter structure as claimed in claim 1, wherein the two side arms are integrally formed with the insulating case.

5. The adjustable power plug adapter structure as claimed in claim 1, wherein the first pivoting portion is a protruding post, and is correspondingly received in the sliding groove of the plug.

6. The adjustable power plug adapter structure as claimed in claim 1, wherein the first inserted member is a plurality of conducting pins.

7. The adjustable power plug adapter structure as claimed in claim 1, wherein a rear end of the plug forms a seal, and the sliding groove is formed on a side of the seal.

8. The adjustable power plug adapter structure as claimed in claim 1, wherein a rear end of the plug has a power cord.

9. The adjustable power plug adapter structure as claimed in claim 1, wherein a rear end of the plug further has a fourth inserted member.

10. The adjustable power plug adapter structure as claimed in claim 9, wherein an electrical storage device is joined on a surface of the plug and electrically connected to the third and fourth inserted members.

11. The adjustable power plug adapter structure as claimed in claim 1, wherein the third inserted member is a plurality of conducting pins, and the second inserted member is a receptacle mated to the conducting pins.

12. The adjustable power plug adapter structure as claimed in claim 1, wherein a movable sliding piece is further received in the sliding groove, and the sliding piece has a second pivoting portion which is coupled to and pivoted with the first pivoting portion.

13. The adjustable power plug adapter structure as claimed in claim 12, wherein an elastic member is further received in the sliding groove, and two ends of the elastic member respectively abut against a side of the sliding piece and a wall of the sliding groove.

14. The adjustable power plug adapter structure as claimed in claim 13, wherein the elastic member is a spring.

15. The adjustable power plug adapter structure as claimed in claim 13, wherein the elastic member is an elastic plate.

16. The adjustable power plug adapter structure as claimed in claim 15, wherein the sliding piece and the elastic plate are integrally formed together, and the elastic plate is extended and bended from a side of the sliding piece.

17. A adjustable power plug adapter structure comprising:

an insulating case having two side arms and a sliding groove;

a first inserted member and a second inserted member oppositely joined in the insulating case and electrically connected to each other; and a plug movably assembled to the insulating case, a third inserted member mated to the second inserted member being disposed at a front end of the plug, a first pivoting portion being disposed on a side of the plug to correspond to the sliding groove for moveable connection of the insulating case to the plug.

18. The adjustable power plug adapter structure as claimed in claim 17, wherein the insulating case has the sliding groove concavely on the side thereof.

19. The adjustable power plug adapter structure as claimed in claim 17, wherein the two side arms are rotatably joined on both sides of the insulating case.

20. The adjustable power plug adapter structure as claimed in claim 17, wherein the two side arms are integrally formed with the insulating case.

21. The adjustable power plug adapter structure as claimed in claim 17, wherein a movable sliding piece is further received in the sliding groove, and the sliding piece has a second pivoting portion correspondingly pivoted with the first pivoting portion.

22. The adjustable power plug adapter structure as claimed in claim 21, wherein an elastic member is further received in the sliding groove, and two ends of the elastic member respectively abut against a side of the sliding piece and a wall of the sliding groove.

23. The adjustable power plug adapter structure as claimed in claim 22, wherein the elastic member is a spring.

24. The adjustable power plug adapter structure as claimed in claim 22, wherein the elastic member is an elastic plate.

25. The adjustable power plug adapter structure as claimed in claim 24, wherein the sliding piece and the elastic plate are integrally formed together, and the elastic plate is extended and bended from a side of the sliding piece.

26. The adjustable power plug adapter structure as claimed in claim 17, wherein the first inserted member is a plurality of conducting pins.

27. The adjustable power plug adapter structure as claimed in claim 17, wherein a rear end of the plug has a power cord.

28. The adjustable power plug adapter structure as claimed in claim 17, wherein a rear end of the plug further has a fourth inserted member.

29. The adjustable power plug adapter structure as claimed in claim 28, wherein an electrical storage device is joined on a surface of the plug and electrically connected to the third and fourth inserted members.

30. The adjustable power plug adapter structure as claimed in claim 17, wherein the third inserted member is a plurality of conducting pins, and the second inserted member is a receptacle mated to the conducting pins.

31. The adjustable power plug adapter structure as claimed in claim 17, wherein the first pivoting portion is a protruding post, and is correspondingly received in the sliding groove of the plug.

32. An adjustable power plug adapter of an adjustable power plug adapter structure, the adjustable power plug adapter comprising:

an insulating case having two side arms; and a first inserted member and a second inserted member oppositely joined in the insulating case and electrically connected to each other;

wherein the insulating case has two sliding grooves concaved on the side thereof, and each sliding groove forms in a horizontal direction for pivotal insert of said plug.

33. The adjustable power plug adapter as claimed in claim 32, wherein the two side arms are rotatably joined on both sides of the insulating case.

34. The adjustable power plug adapter as claimed in claim 32, wherein the two side arms are integrally formed with the insulating case.

35. The adjustable power plug adapter as claimed in claim 32, wherein each of the two side arms has a pivoting portion.

36. The adjustable power plug adapter as claimed in claim 35, wherein the pivoting portion is a protruding post or a circular hole.

37. The adjustable power plug adapter as claimed in claim 32, wherein each of the two side arms has a sliding groove.

38. The adjustable power plug adapter as claimed in claim 32, wherein the first inserted member and the second inserted member are a plurality of conducting pins and a receptacle of the conducting pins, respectively.

39. An adjustable power plug adapter of an adjustable power plug adapter structure, the adjustable power plug adapter comprising:

an insulating case having two side arms; and a first inserted member and a second inserted member oppositely joined in the insulating case and electrically connected to each other;

wherein the insulating case has a pair of protrusions being protruded on opposite sides thereof, and each protrusion protruded in a horizontal direction for insert into a pair of sliding grooves formed within a plug member.

* * * * *